US010905294B2

(12) United States Patent
Blair et al.

(10) Patent No.: US 10,905,294 B2
(45) Date of Patent: Feb. 2, 2021

(54) VERSATILE TOILET AID

(71) Applicants: Judy Cecilia Blair, Tucson, AZ (US); Curt N Blair, Tucson, AZ (US)

(72) Inventors: Judy Cecilia Blair, Tucson, AZ (US); Curt N Blair, Tucson, AZ (US)

(73) Assignee: Judy C Blair

( * ) Notice: Subject to any disclaimer, the term of this patent is extended or adjusted under 35 U.S.C. 154(b) by 0 days.

(21) Appl. No.: 16/549,706

(22) Filed: Aug. 23, 2019

(65) Prior Publication Data

US 2019/0374077 A1 Dec. 12, 2019

Related U.S. Application Data

(63) Continuation-in-part of application No. 13/838,242, filed on Mar. 15, 2013, now Pat. No. 10,390,667.

(60) Provisional application No. 61/670,878, filed on Jul. 12, 2012.

(51) Int. Cl.

| | |
|---|---|
| ***A47K 13/28*** | (2006.01) |
| ***A47K 17/02*** | (2006.01) |
| ***A47K 13/00*** | (2006.01) |

(52) U.S. Cl.
CPC ..... *A47K 13/28* (2013.01); *A47K 13/005* (2013.01); *A47K 17/02* (2013.01)

(58) Field of Classification Search
CPC ..... A47K 13/005; A47K 13/28; A47K 17/02
USPC ..... 4/239
See application file for complete search history.

(56) References Cited

U.S. PATENT DOCUMENTS 3,263,245 A * 8/1966 Ettinger ..... A47K 17/02 4/254
10,154,764 B2 * 12/2018 Khaytman ..... A47K 17/02

* cited by examiner

*Primary Examiner* — Tuan N Nguyen
(74) *Attorney, Agent, or Firm* — Fresh IP PLC; Clifford D. Hyra; Aubrey Y. Chen

(57) ABSTRACT

A new toilet aid apparatus has a positioning aid configured to be adjusted and positioned on the toilet seat to adjust the effective size of the toilet seat, and a securing mechanism configured to secure the adjustable back support to a toilet and thereby fix the effective size of the toilet seat. The positioning aid may support the back of a user seated on a toilet seat and may be easily removed or moved out of the way for users not needing the positioning aid.

17 Claims, 15 Drawing Sheets

VERSATILE TOILET AID

This application is a continuation-in-part of U.S. application Ser. No. 13/838,242 filed Mar. 15, 2013, which claims the benefit of U.S. Provisional Application No. 61/670,878, filed Jul. 12, 2012, both of which are hereby incorporated by reference in their entirety.

FIELD OF THE INVENTION

This disclosure describes herein methods and systems for providing a toilet support aid and toilet reducer. More specifically, this disclosure describes a positionable and removable back support for a toilet seat.

BACKGROUND

Great efforts have been made throughout history to offer caregivers easier ways to potty train a child, and provide toilet aid for people with certain disabilities and the elderly.

Some conventional support devices for toilets require permanent attachment to existing toilets. Conventional potty training devices require an extra transitional step for a child, requiring the child to first use a separate floor trainer device, and then move to the traditional "toilet rings," which are fixed toilet reducers.

Needs exist for improved toilet training and support methods or devices.

SUMMARY

It is to be understood that both the following summary and the detailed description are exemplary and explanatory and are intended to provide further explanation of the invention as claimed. Neither the summary nor the description that follows is intended to define or limit the scope of the invention to the particular features mentioned in the summary or in the description.

In certain embodiments, the disclosed embodiments may include one or more of the features described herein.

By providing a unique re-positioning and adjustment feature, a new toilet trainer/aid, unlike current systems and methods related to support devices for a toilet, offers the confidence a child needs to sit directly on the toilet without having the feeling of sinking into a big hole. The new toilet trainer shortens the tedious process of potty training a child. Embodiments of the toilet aid position a user towards the front of the toilet seat, rather than in the middle, encouraging a proper body position for elimination with bent legs and a forward lean.

Example embodiments disclosed herein describe devices, methods, systems and apparatuses that are configured to provide a positionable and/or removable back support for a toilet seat, which may be used for potty training and/or a toilet aid for people with certain disabilities. The toilet aid may be inflatable for compact and lightweight storage and transportation, and may be made of vinyl or any other flexible plastic or material. The toilet aid may have a back support, which may be variable in height, and may be foldable and be temporarily or permanently attached to an existing toilet. Back supports in embodiments may be anywhere from 2" to 30" in vertical height when in use, and in certain embodiments 5" to 24". Embodiments specifically for children may be 4" to 12" in vertical height when in use and embodiments for adults may run 12" to 24". The back supports may be fixed in height or variable within a given range. The toilet aid may sit flat on a toilet seat and not provide back support, but merely a cue as to where to sit on the existing toilet seat, and may fold up out of the way when not in use.

Embodiments described herein disclose a toilet aid with an accompanying mounting facility for attaching, connecting, and positioning a potty training device on an existing toilet, toilet bowl rim, toilet seat, seat lid, toilet water tank, toilet base support, and/or any other part of an existing toilet. The potty training device may then be removed, if desired or required, from the existing toilet, toilet bowl rim, toilet seat, seat lid, toilet water tank, toilet base support, and/or any other part of an existing toilet. For the sake of brevity hereinafter, one skilled in the art will understand that a toilet, toilet bowl rim, toilet seat, toilet tank, toilet pedestal base support and/or seat lid may be referred to as a "toilet seat" where an attachment point is referenced.

The device is a toilet aid that can be adjusted to the comfort of a user and may provide back support. Back support is important for weaker individuals, such as small children and the elderly, to feel comfortable and confident using the toilet. Back support allows users to lean their weight against a secure object and relieves concern of falling off or into the toilet. The versatile toilet aid reduces the effective size of the toilet seat and can be positioned to create an overall toilet seat size most comfortable for any given user. A safe and unique mechanism secures the toilet aid to the toilet, preventing undesirable movement of the toilet aid during use and providing the confidence a user needs to remain seated on the existing toilet.

An optional positioning mechanism may be used to readily return the toilet aid to the same position over and over, even when repeatedly removed from and returned to a toilet. In this way, the same toilet aid can be used by multiple users of differing size, requiring different positioning of the toilet aid, without worrying about or spending significant time getting the toilet aid back into the correct position for each user. The device allows for use of an existing toilet seat by any sized user without any parts besides the toilet aid and whatever securing and positioning mechanisms are utilized. The securing and positioning mechanisms utilized as described below may be minimal and not otherwise alter the surface of the toilet seat or even be visible when in use.

Embodiments may describe a potty training device comprised of a strong plastic material, or other similar materials that may be removably disposed, mounted and/or placed on a toilet seat. The potty training device may provide back support for users and/or accommodate and help position a smaller user closer to the front of the toilet.

When the toilet aid device is positioned on an existing toilet seat, the trainer reduces the effective size of an existing opening of a toilet seat, which may increase the confidence, comfort and safety of a user.

Embodiments of the device may be easily placed on an existing toilet or removed for temporary or longer term use. However, some embodiments may be fixedly attached to a toilet and some embodiments may not be permanently attached to the toilet.

Embodiments may be configured to include a removable and positionable indexing facility for repeatability of placement of the toilet aid. With such a facility, the toilet aid can be removed and replaced without changing its position on the toilet seat.

Embodiments may allow for a shortened potty training process and reduce hassles enormously, giving the child the needed confidence to sit on an existing toilet in a short period of time, which may be one goal of potty training a child. Therefore, embodiments may be a one-step potty training device where no transition is needed from a floor-potty to toilet.

Some embodiments describe herein a potty training device that is simple and easy to use that facilitates portability and use away from home and during travel. The potty training device may have a handle for ease of transportation and of stabilization during installation, which may be made of the same material as the device itself and/or may include a grippy material, such as may be used for a positional indexing facility for the potty training device. The potty training device may be easy to clean and store. Embodiments may also encourage hygienic habits in children at an early age.

These and other aspects of the disclosure will be better appreciated and understood when considered in conjunction with the following description and the accompanying drawings. It should be understood, however, that the following description, while indicating various embodiments of the disclosure and numerous specific details thereof, is given by way of illustration and not of limitation. Many substitutions, modifications, additions and/or rearrangements may be made within the scope of the disclosure without departing from the spirit thereof, and the disclosure includes all such substitutions, modifications, additions and/or rearrangements.

These and other objectives and features of the invention are apparent in the disclosure, which includes the above and ongoing written specification.

BRIEF DESCRIPTION OF THE DRAWINGS

The features and advantages of example embodiments will become more apparent by describing in detail example embodiments with reference to the attached drawings. The accompanying drawings are intended to depict example embodiments and should not be interpreted to limit the intended scope of the claims. The accompanying drawings are not to be considered as drawn to scale unless explicitly noted.

Figure 1:
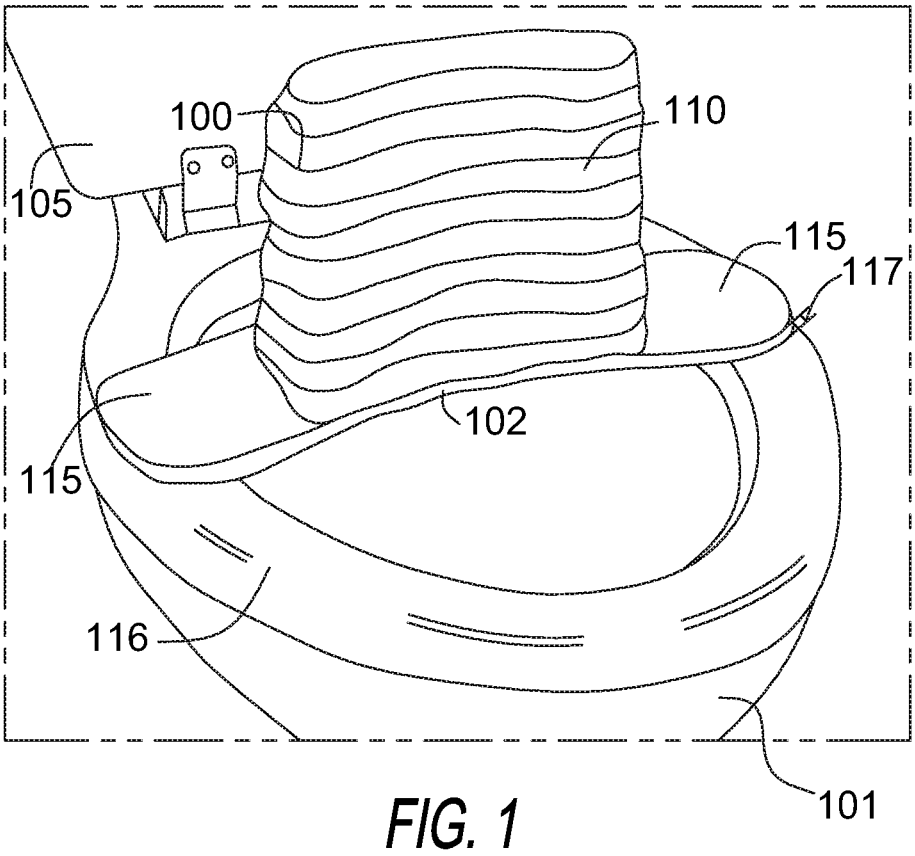
FIG. 1 depicts an embodiment of a toilet aid device with a toilet seat in an open position.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but, on the contrary, the intention is to cover all modifications, equivalents, and alternatives falling within the spirit and scope of the invention as defined by the appended claims.

DETAILED DESCRIPTION

Illustrative embodiments of the invention are described below. In the interest of clarity, not all features of an actual implementation are described in this specification. It will of course be appreciated that in the development of any such actual embodiment, numerous implementation-specific decisions may be made to achieve the developers' specific goals, such as compliance with system-related and business-related constraints, which may vary from one implementation to another. Moreover, it will be appreciated that such a development effort might be complex and time-consuming, but may nevertheless be a routine undertaking for those of ordinary skill in the art having the benefit of this disclosure.

Embodiments of the present invention will now be described with reference to the attached figures. Various structures, connections, systems and devices are schematically depicted in the drawings for purposes of explanation only and so as to not obscure the disclosed subject matter with details that are well known to those skilled in the art. Nevertheless, the attached drawings are included to describe and explain illustrative examples of the present invention. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

It will be understood that although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments. The terms front and rear are used for convenience and are not limiting. The interfaces and associated orifices and enclosure parts may be on any side of a device. As used herein, the term "and/or" includes any and all combinations of one or more of the associated listed items.

It will be understood that when an element is referred to as being "connected" or "coupled" to another element, it may be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between", "adjacent" versus "directly adjacent", etc.).

The terminology used herein is for the purpose of describing particular embodiments only and is not intended to be limiting of example embodiments. As used herein, the singular forms "a", "an" and "the" are intended to include the plural forms as well, unless the context clearly indicates otherwise. It will be further understood that the terms "comprises", "comprising", "includes" and/or "including", when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

One skilled in the art will appreciate that the toilet aid device as described below may be configured to be disposed along, within, above, underneath, between, on top of, etc. various components of a toilet of any shape and or size. Furthermore, the toilet aid device may be disposed on various components of a toilet at different positions for users of different shapes and sizes. For example, if it is described that a toilet aid device is secured to a toilet seat cover, it will be understood that the toilet aid device may be in another embodiment secured or coupled to a toilet seat, water tank or pedestal base toilet bowl.

Embodiments provide for a trainer that is easily positionable, removable and replaceable on a toilet seat. By being positionable, the potty training device may be adjusted or be disposed as desired, required or as needed to change an effective open area of an existing toilet seat to different shapes and sizes for a given user.

The positioning of the trainer may allow for users of different sizes to sit comfortably on a toilet seat while also providing a back support for the user. The position of the trainer can be modified or adjusted as a child grows, or if a differently-sized user is also being trained and requires use of the potty training device as a back support. Accordingly, embodiments are configured to accommodate a plurality of differently-sized users or to be positioned differently as a user sees fit.

The toilet trainer includes a back support configured to allow the potty training device to begin the training process by sitting a child directly on an existing toilet at an early age. The toilet trainer may be configured to fit most existing toilets and toilet seats whether round or elongated.

Once the device is installed and the child is positioned, the device may be configured not to move, tremble, shake, or pinch, which may provide confidence in the child to remain sifting on the existing toilet. This may encourage the child to return to the toilet every time he/she needs to go to the restroom.

Further embodiments may help some other users with certain disabilities to sit and rest their backs comfortably on an existing toilet. Because the main purpose of a toilet tank is to store water, toilet tanks do not provide sufficient back support to sitting users. As such, embodiments may be configured to provide back support to users.

Figure 2:
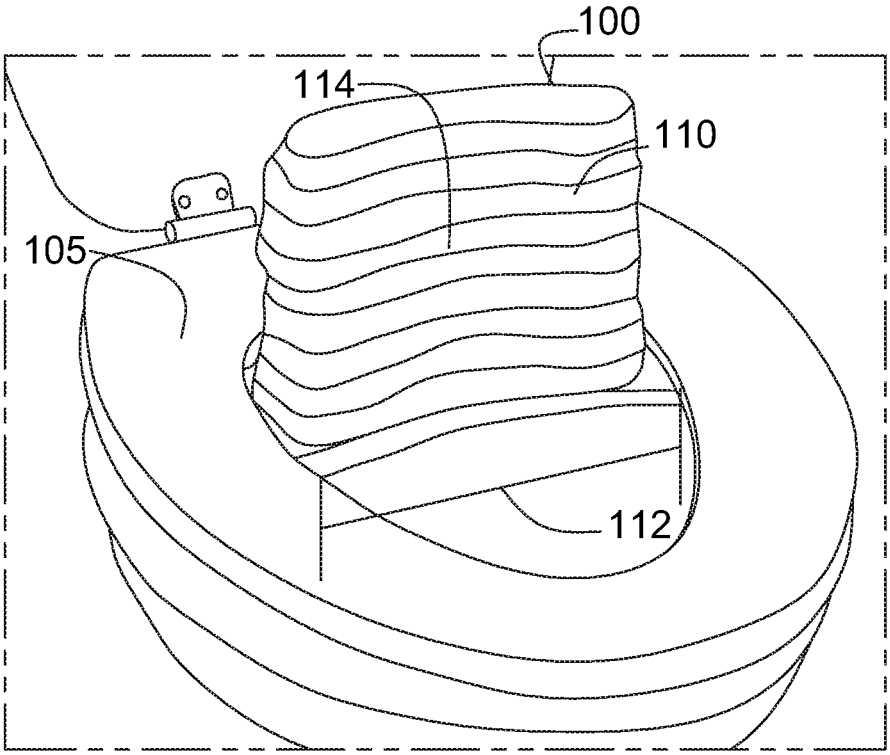
FIG. 2 depicts an embodiment of a toilet aid device with a toilet seat in a closed position.
Figure 3:
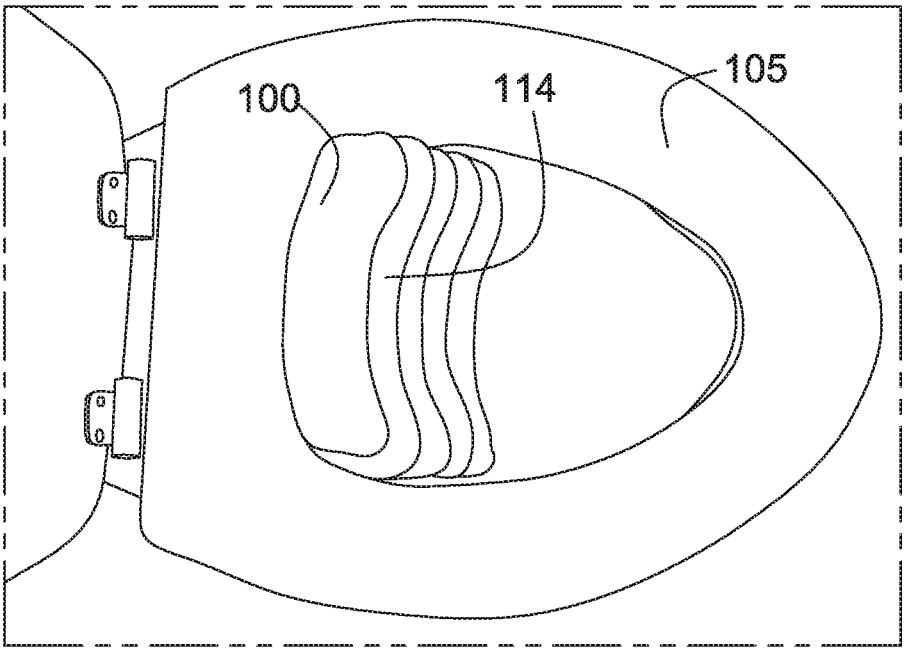
FIG. 3 depicts an embodiment of a toilet aid device from a bird's eye view with a toilet seat in a closed position.

Turning to FIGS. 1-3, FIGS. 1-3 depict an embodiment of a toilet aid device 100. FIG. 1 depicts an embodiment of toilet aid device 100 with a toilet seat 105 in an open position. FIG. 2 depicts an embodiment of toilet aid device 100 with toilet seat 105 in a closed position. FIG. 3 depicts an embodiment of toilet aid device 100 from a bird's eye view with toilet seat 105 in a closed position.

Toilet aid 100 includes a back support 110 and projections 115. Back support 110 may be a vertical projection with respect to a base 102 of toilet aid 100. As shown in FIG. 2, a width 112 of back support 110 may be about the same length as the widest portion of an inner circumference of toilet seat 105. As shown in FIG. 3, back support 110 may be have concave surface 114 configured to be adjacent to a user's back, and provide support to the user while the user is seated at a toilet 101. However, in various embodiments the back support and projections may be various shapes and sizes, for example the back support may be designed to be ergonomic or to extend high on a user's back and projections may be designed to help support the weight of a user. The same is true of corresponding structures in other illustrated embodiments. In alternative embodiments, other attachments structures may be used to secure the back support to the toilet, such as clips or clamps, or other fastening means, rather than the side projections.

Side projections 115 may be tabs configured to sit on a toilet bowl rim 116 and under toilet seat 105 (As shown in FIGS. 2 and 3). Side projections 115 may also have a thickness 117 that is substantial enough so that toilet aid 100 may be captured, and held in place between the toilet seat rim 115 and toilet seat 105 by the weight of the user when the user is seated on toilet seat 105.

Toilet aid 100 may be disposed along any position on toilet bowl rim 116 to accommodate the needs and/or desires of a particular user before toilet seat 105 is lowered on top of side projections 115. When toilet seat 105 is in a lowered positioned, toilet aid 100 may be positioned or readjusted to any other position if the user desires, so that when toilet seat 105 is in a closed position and a user is seated on toilet seat 105, toilet aid 100 is secured between toilet seat 105 and toilet bowl rim 116 via compressive force applied by the user's body weight and toilet bowl rim 116 to side projection 115.

In embodiments a positional indexing facility (not shown) may be comprised of an adjustable, variable length arm with indexed detents between any surface of the rear of back support 110 and the inside rear of the toilet seat 105. The indexing facility may be adjusted to determine an appropriate position of the back support 110 and toilet aid 100 for a particular user.

Figure 4:
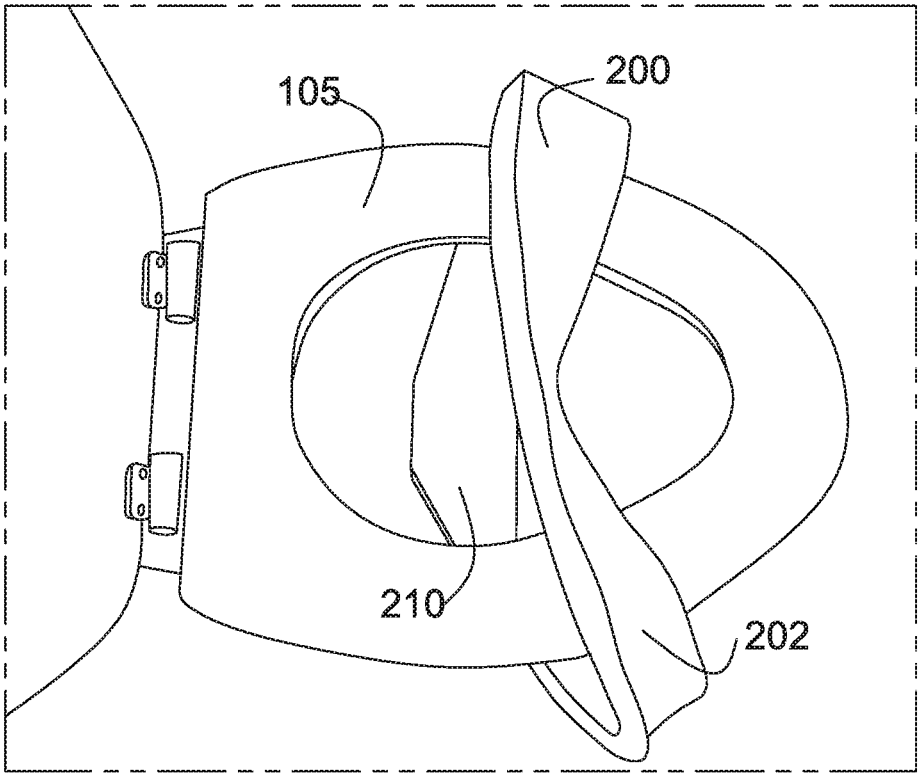
FIGS. 4 and 5 depict top views of a toilet aid device disposed on a toilet seat according to an embodiment.
Figure 5:
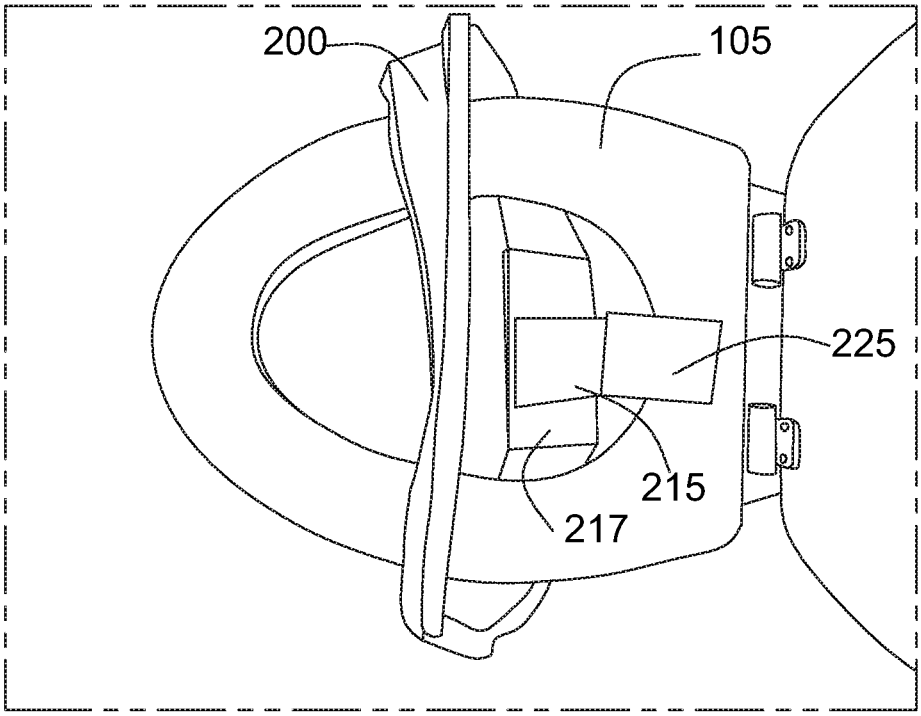
Figure 6:
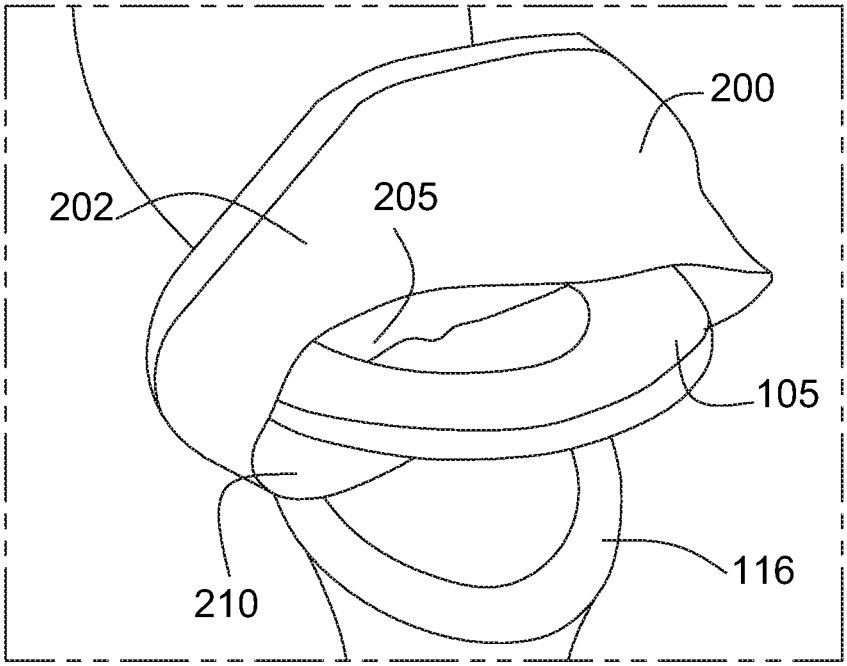
FIG. 6 depicts an isometric view of a toilet aid device disposed on a toilet seat according to an embodiment.
Figure 7:
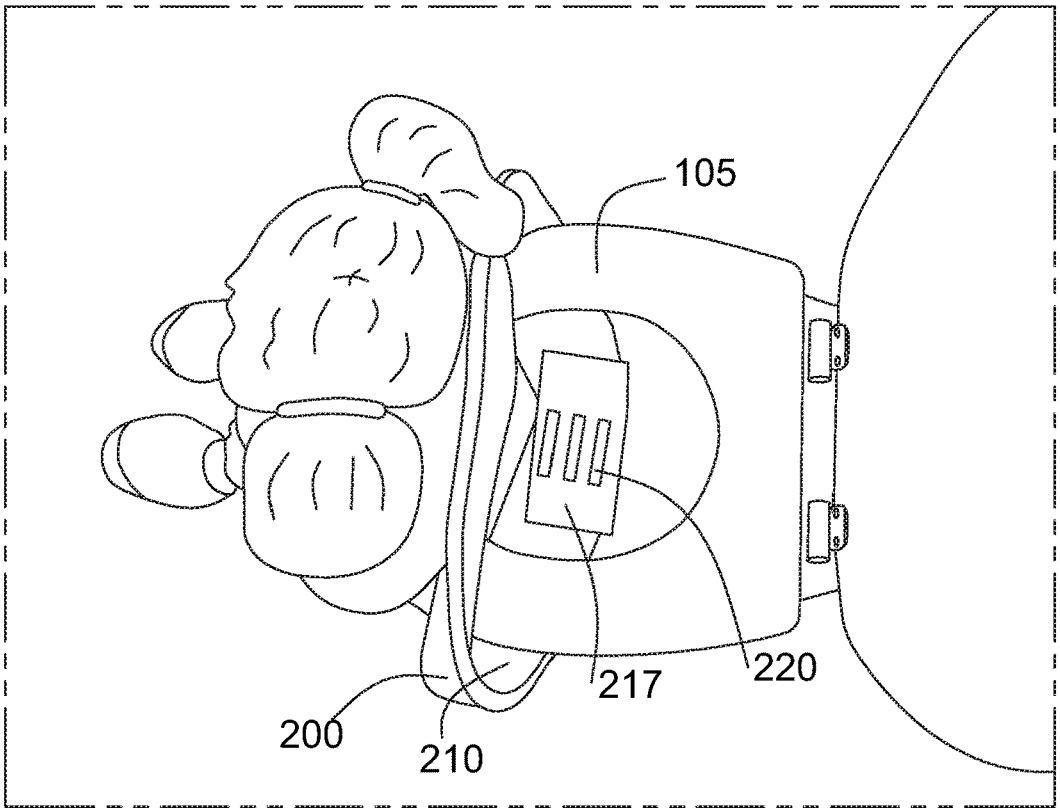
FIG. 7 depicts an embodiment of a doll (representing a user) sitting on toilet seat with a toilet aid device.
Figure 8:
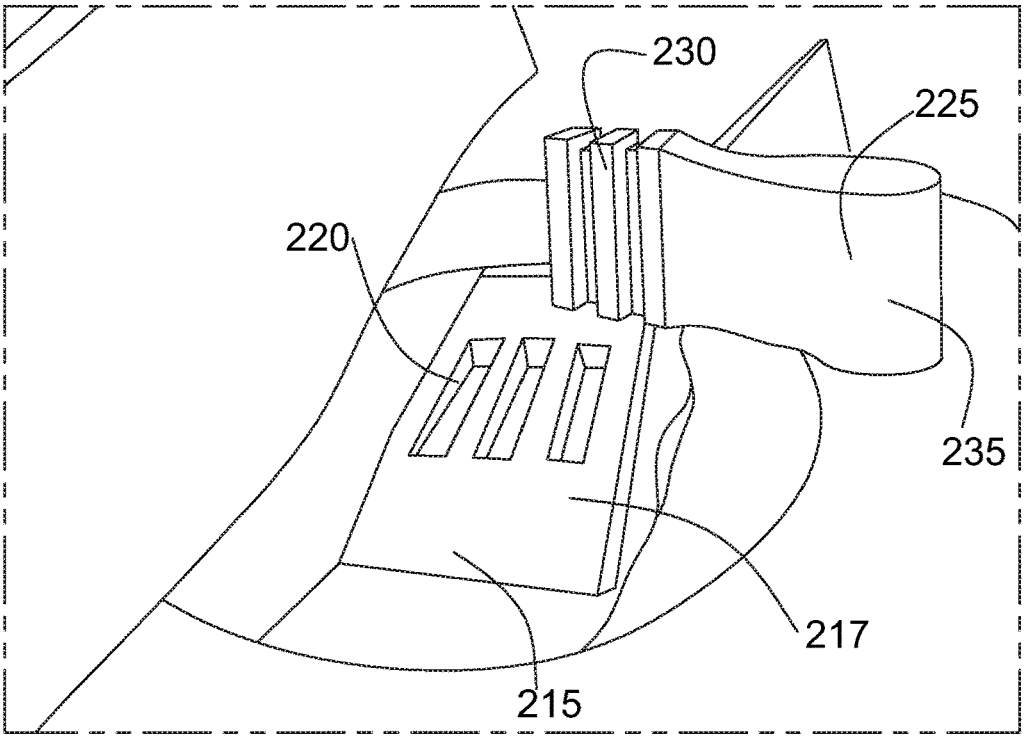
FIG. 8 depicts an embodiment of a toilet aid device with a positional indexing facility.

FIGS. 4-8 depict various embodiments of a toilet aid 200. FIGS. 4 and 5 depict top views of toilet aid 200 disposed on a toilet seat 105. FIG. 6 depicts an isometric view of toilet aid 200 disposed on a toilet seat 105 according to an embodiment. FIG. 7 depicts an example embodiment of a doll (representing a user) sitting on toilet seat 105 with toilet aid 200. FIG. 8 depicts an embodiment of toilet aid 200 with a positional indexing facility 215.

Toilet aid 200 may include a curved single piece 202 with an orifice 205 disposed within curved single piece 202 and a flat surface 210.

Orifice 205 may be an opening within toilet aid 200 configured to be received by toilet seat 105 and to be able to slide around toilet seat 105 such that a user may position toilet aid 200 as desired or required.

Flat surface 210 may be a flat and strong surface that is configured to be disposed in-between a bottom of toilet seat 105 and toilet bowl rim 116. Furthermore, curved piece 202 may be configured to conform to a user's back to provide support to the user if the user is in a seated position.

Toilet aid 200 may be configured to be disposed along any position of toilet seat 105 to accommodate the needs or requirements of a particular user before toilet seat 105 is in a lowered position. Toilet aid 200 may also be repositioned once toilet seat 105 is in a lowered positioned. Toilet aid 200 may be held in place by a user sitting on toilet seat 105 applying compressive force to the toilet aid 200.

Toilet aid 200 (or another embodiment) may include a brake that braces against the toilet seat cover and/or, in various embodiments, other parts of a toilet such as the tank or bowl, and attached to the back of the back support. This brake can serve two purposes. First, it can prevent movement of the toilet aid during use—for example if a user leans his or her weight against the back support and any other securing mechanism is insufficient to prevent movement. Second, it may include a positional indexing facility 215 for repeatable placement of the toilet aid 200.

Indexing facility 215 may include a first portion 217 with notches, grooves, indentations, and/or orifices 220 that attaches to the back of the back support 202 or flat portion 210. A second portion 225 of indexing facility 215 may attach to the toilet seat cover or rear of the toilet seat, or may have a stop 235 that butts against the toilet seat, toilet bowl rim, and/or toilet seat cover, etc. to prevent rearward movement, and may include projections or ribs 230 that are configured to be received by orifices 220.

By inserting the projections 230 in the desired orifices 220, the position of the toilet aid 200 can be set. For example, when the first projection is inserted in the last orifice, the trainer 200 may be in the proper and comfortable position for a child of one size, while when the first projection is inserted in the first orifice, the trainer 200 may be in the desired position for a child of another size. Thus, the indexing facility 215 may be used to quickly and precisely position the toilet aid 200 for a given user. Although in the figure three projections and orifices are shown, of course in various embodiments any number of projections and orifices in any shape can be utilized.

Figure 9:
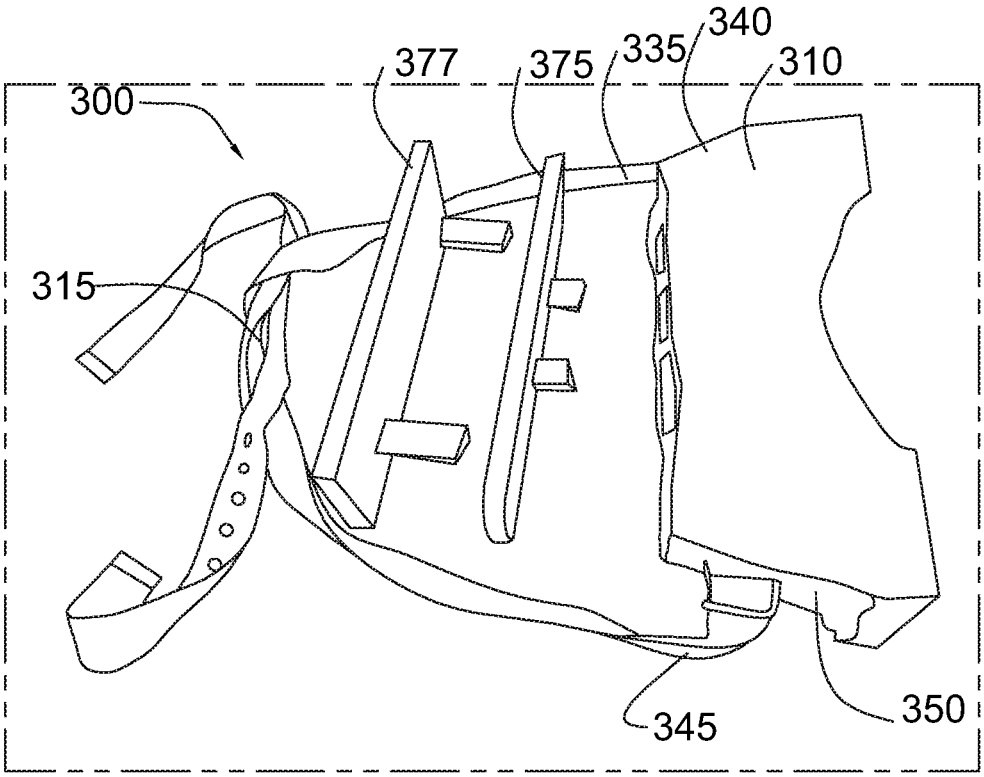
FIG. 9 depicts parts of a toilet aid device according to an embodiment.
Figure 10:
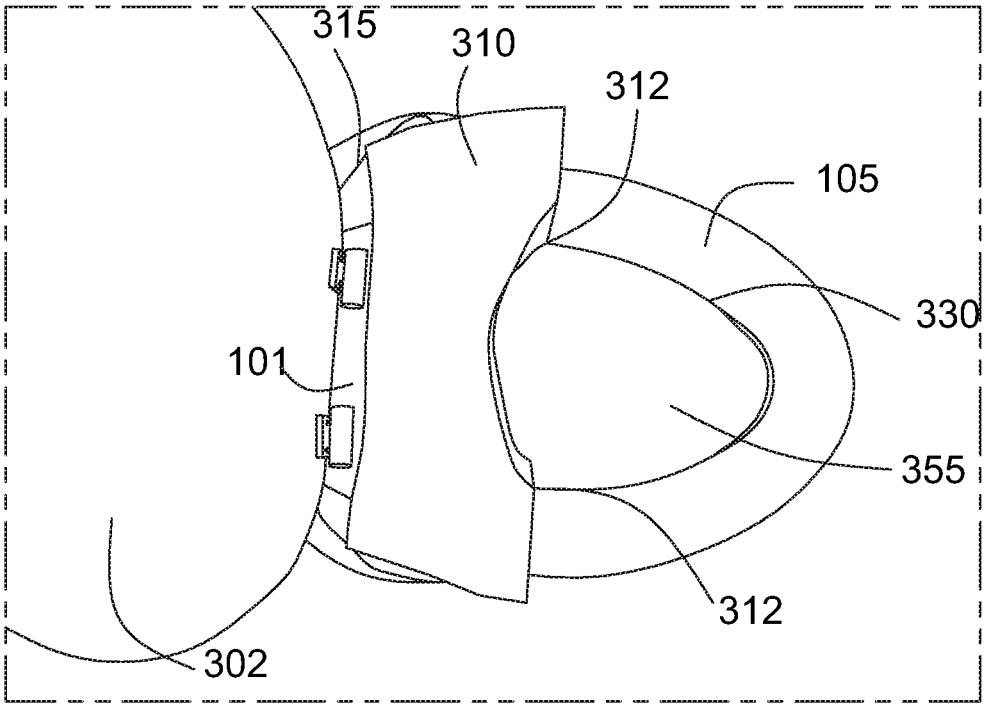
FIG. 10 depicts a top view of a toilet aid device according to an embodiment.
Figure 11:
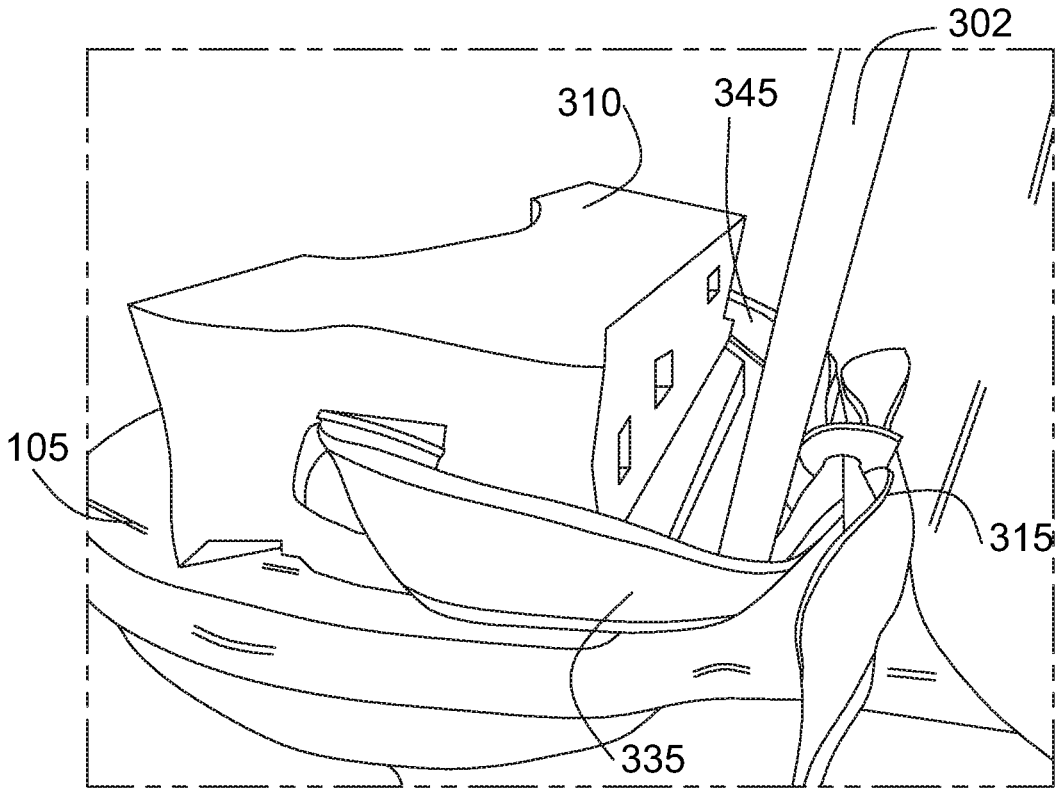
FIG. 11 depicts a side view of a toilet aid device according to an embodiment.
Figure 12:
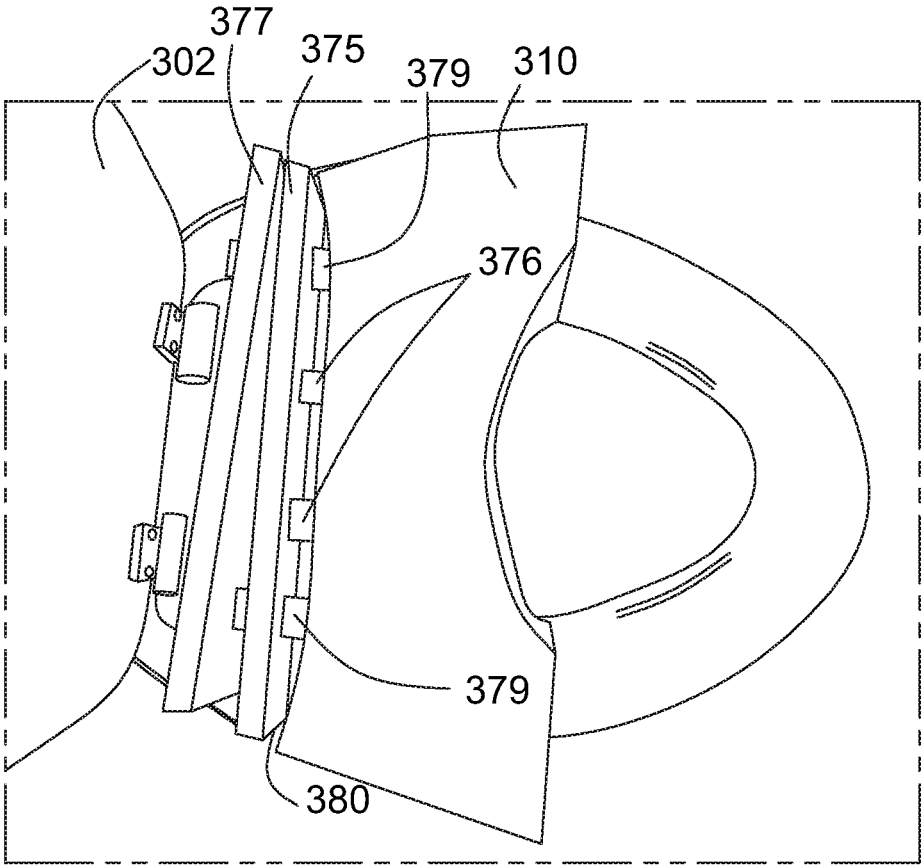
FIG. 12 depicts a top view of a toilet aid device with additional blocks positioned behind the toilet aid device according to an embodiment.
Figure 13:
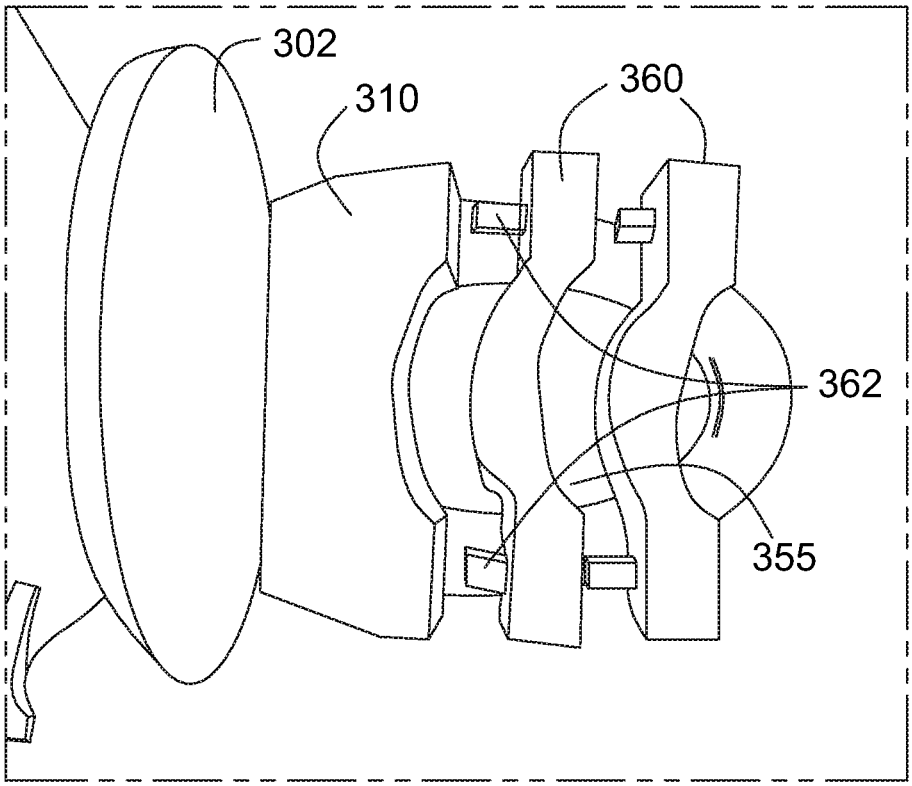
FIG. 13 depicts an example embodiment of a toilet aid device with blocks positioned in front of the toilet aid device.

FIGS. 9-13 depict an example embodiment of toilet aid 300. FIG. 9 depicts the parts of toilet aid 300 according to an embodiment. FIG. 10 depicts a top view of toilet aid 300 according to an embodiment. FIG. 11 depicts a side view of toilet aid 300. FIG. 12 depicts a top view of toilet aid with additional blocks positioned behind toilet aid. FIG. 13 depicts an example embodiment of toilet aid 300 with blocks positioned in front of toilet aid 300.

Toilet aid 300 may be comprised of an adjustable size back support 310, a strap or similar facility 315, and blocks 375, 377.

Strap 315 may have a first piece 335 disposed on a first side 340 of toilet aid 300 and have a second piece 345 disposed on a second side 350 of toilet aid 300. First piece 335 and second piece 345 may be configured to wrap around a toilet seat cover 302 and be coupled together to secure toilet aid 300 to toilet 101. As one skilled in the art will appreciate, first piece 335 and second piece 345 may be coupled together via any known manner, such as with clips, buckles, Velcro, etc. One skilled in the art will also appreciate that strap 315 may be configured to be wrapped around a toilet seat tank (not shown) instead of a toilet seat cover 302.

In other embodiments, straps 315 may be supplemented or substituted with another fastener. Any known fastening mechanism(s) may be used to secure the toilet aid 300 to the toilet. For example, clamps may be applied to any part of the toilet, such as the toilet bowl rim, toilet seat, toilet seat cover, etc. A securing structure may extend from sides of the toilet aid 300, similar to projections 115, and sit between the toilet seat and toilet bowl rim and be secured by the weight of a user. Suction cups, flanges, wedges, and/or high friction contact materials may also be used.

Back support 310 may be configured to rest upon the rear part of the toilet seat 101, and be configured to be substantially flush with toilet seat cover 302 when toilet seat cover 302 is in an upright position. Back support 310 may have a concave shape and be configured to receive a back of a user to provide support for the user. Furthermore, back support 310 may have inner ends 312 that are configured to be positioned aligned with an inner circumference 330 of toilet seat 105. When back support 315 is positioned upon a rear part of toilet seat 101, an orifice 355 within toilet seat 105 may be reduced in size.

The size of toilet aid 300 may be adjusted by adding or subtracting nesting blocks 360 that are configured to fit/couple onto a front part 370 of back support 310 (as shown in FIG. 13) or adding or subtracting nesting blocks 375, 377 that are configured to fit/couple onto a rear part 380 of back support 310 (as shown in FIG. 12).

Nesting blocks 360 may be configured to be disposed in front of back support 310 and be concave in shape to provide back support for a user. Nesting blocks 360 have projections 362 that are configured to be received by either toilet aid 300 or another nesting block 360. Therefore, nesting blocks 360 may be coupled to other nesting blocks 360 or back support 310 or removed to adjust the size of orifice 355 for different users on the same toilet seat 301. Nesting blocks 360 may have various shapes and sizes to accommodate variously-sized users, for example different nesting blocks could be swapped out for children and for elderly users, where the nesting blocks for the elderly may extend higher or generally be larger.

Nesting blocks 375 and 377 may be substantially planar in shape and be configured to be disposed behind toilet aid 300, such that a positioning of toilet aid 300 may be adjusted. Nesting block 375 may have projections 376 that are configured to be received by toilet aid 300, and nesting block 377 may have projections 379 that are configured to be inserted through openings in nesting block 375 and received by back support 310. As shown in FIG. 12, projections 376 may be positioned more towards the center of nesting block 375 than projections 379 of nesting block 377. However, one skilled in the art will appreciate that projections 379 and 376 may be disposed at any position along nesting blocks 377 and 375, respectively.

By adding or subtracting nesting blocks 360, 375 and/or 377, seat trainer 300 may be disposed at any desired or required position for a particular user on an existing toilet seat 105.

In various embodiments, nesting blocks such as 310, 360, 375 and/or 377 may be cushioned and/or padded, particularly on surfaces intended to contact the user, to provide more comfort to a user. Cushioning and/or padding may include a soft filler and/or surface material such as cotton or other fabric, rubber, synthetic foam, etc. In some embodiments, one block intended to always serve as the contact point for a user may be padded/cushioned and the remaining blocks may be unpadded. User-contacting portions may be similarly cushioned/padded in any embodiments, including embodiments the same or similar to those shown in FIG. 1, FIG. 5, FIG. 18, FIG. 19, FIG. 20, etc.

In another embodiment, a toilet aid may be comprised of a back support which rests upon the rear part of the toilet seat. In this embodiment, the toilet aid may be positioned front to back in the appropriate place along a toilet seat to accommodate the needs of a particular user before it is fixed in place by clamps or a similar device or facility disposed between bottom sides of the toilet aid and the bottom of the existing toilet seat rim. A positional indexing facility, if used, may be comprised of an adjustable, variable length arm with indexed detents between the bottom of the rear of the toilet aid and the inside rear of the toilet seat, which may be similar to indexing facility 215.

In another embodiment, a toilet aid may be comprised of a back support and a mounting plate, and both pieces may fit together in a range of two or more indexed positions. The mounting plate may be crescent-shaped, round or oval and cover the back of the toilet seat, or the entire toilet seat surface. This embodiment differs from others disclosed in that the user sits on a surface that is part of the device, and not the existing toilet seat. The mounting plate may be fixed in place by clamps, similar devices or a similar facility between the sides of the plate and the bottom of the existing toilet bowl rim. The back support may be configured to clip into one of two or more indexed positions of the mounting plate to facilitate the appropriate positioning of a particular user on the existing toilet seat.

Figure 14:
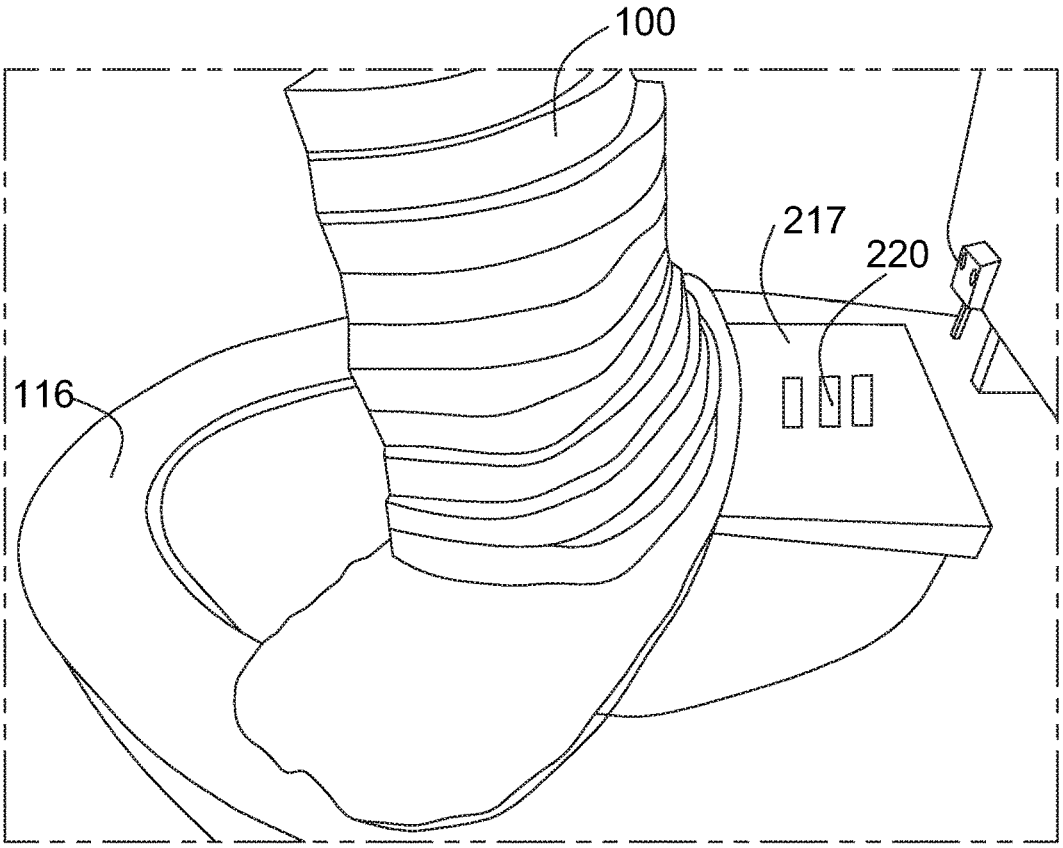
FIG. 14 depicts an embodiment of a toilet aid device as shown in FIGS. 1-3 with the addition of a positional indexing facility receiver element in the rear.

FIG. 14 depicts an embodiment of a toilet aid 100 as shown in FIGS. 1-3 with the addition of a positional indexing facility first portion receiver element 217 having notches 220 in the rear. This receiving portion 217 of the positional indexing facility may be attached to the toilet aid 100 by any known means, such as integral construction, plastic welding, mechanical fasteners such as bolts, adhesives, clips, etc. In some embodiments, the receiving portion 217 of the positional indexing facility 215 is removably attached to the toilet aid 100, for example by snapping or clicking into a receptacle in the rear of the toilet aid 100. Although in FIGS. 14-18 the positional indexing facility is shown attached to one embodiment of the toilet aid 100, the positional indexing facility may also be applied to the other embodiments shown, such as the embodiments of FIGS. 4-8 and 9-13.

Figure 15:
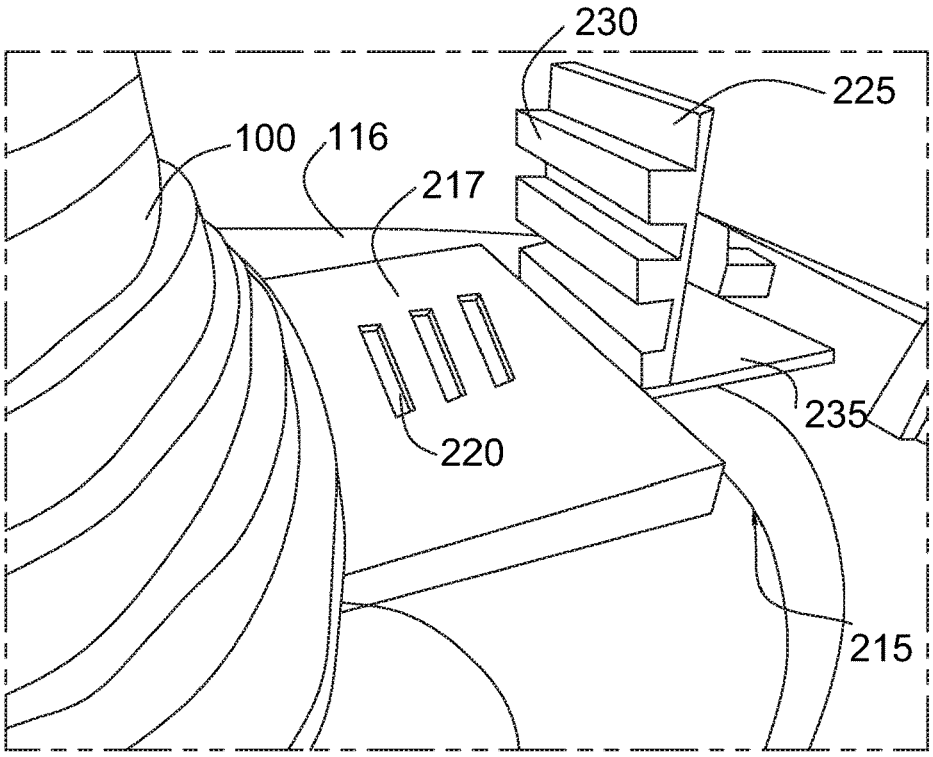
FIG. 15 depicts an embodiment of a toilet aid device as shown in FIG. 14 with complete positional indexing facility abutting a toilet bowl rim.

FIG. 15 depicts an embodiment of a toilet aid 100 as shown in FIG. 14 with complete positional indexing facility 215, having receiver portion 217 and second portion 225 with projections 230 and contact piece 235, acting as a stop, makes contact with or stops against toilet bowl rim 116 or toilet seat 105. The positional indexing facility 215 contact point with the toilet may include friction-increasing material, such as a rubbery, tacky, or textured material, to enhance stability during use and reduce slight side-to-side and back-and-forth movements and the like. Since most toilet surfaces are smooth, suction cup-like structures may also be useful for this purpose.

Figure 16:
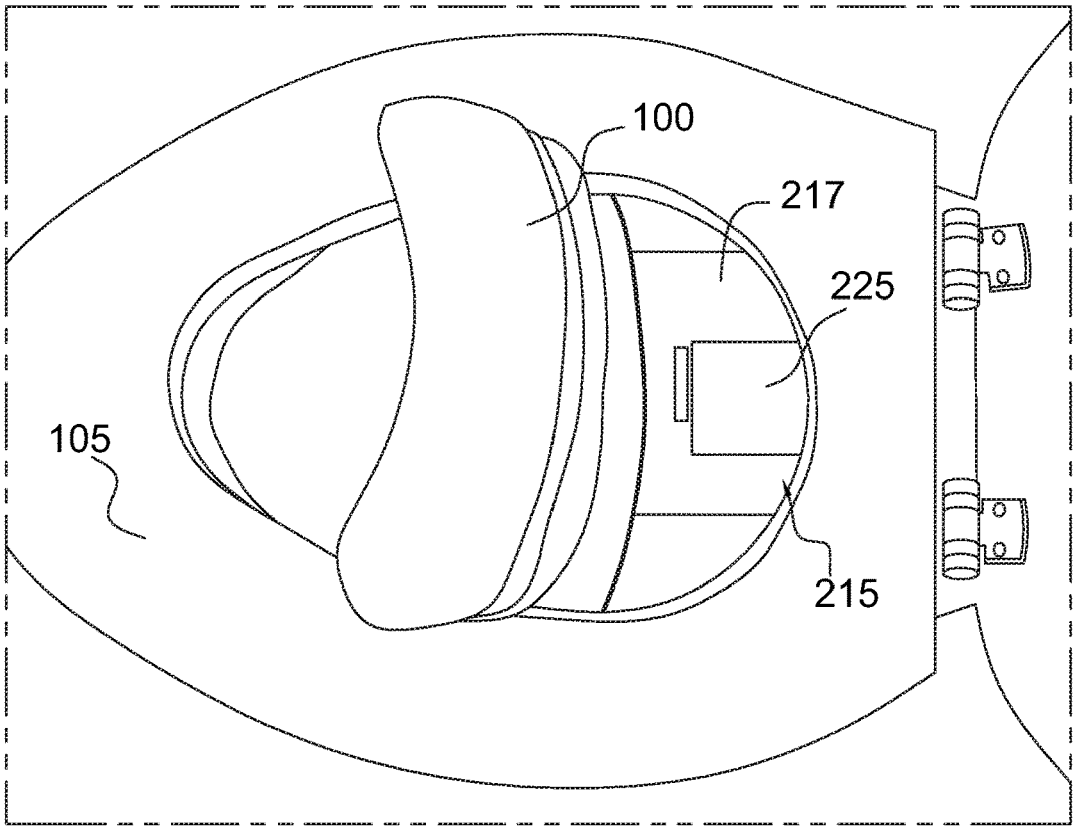
FIG. 16 depicts an embodiment of a toilet aid device as shown in FIG. 15 with the toilet seat in the down position.

FIG. 16 depicts an embodiment of a toilet aid 100 as shown in FIG. 15 with the toilet seat 105 in the down position. Here, two of the projections 230 of second portion 225 are inserted in notches 220 of receiving first portion 217, while contact piece 235 stops against the toilet, thus fixing the indexing facility 215 and toilet aid 100 in place. Projections 230 may be secured within notches 220 by a tight fit that wedges the projections 230 in place and may require some force to dislodge them, or by snap projections or any other known securing method. To adjust the position of the toilet aid 100, projections 230 are removed from notches 220. Although this embodiment uses notches and projections to removably connect the portion secured to the toilet aid 100 and the portion secured to the toilet, in other embodiments other mechanisms for removable connection can be used, such as snaps, clips, or other fasteners.

Figure 17:
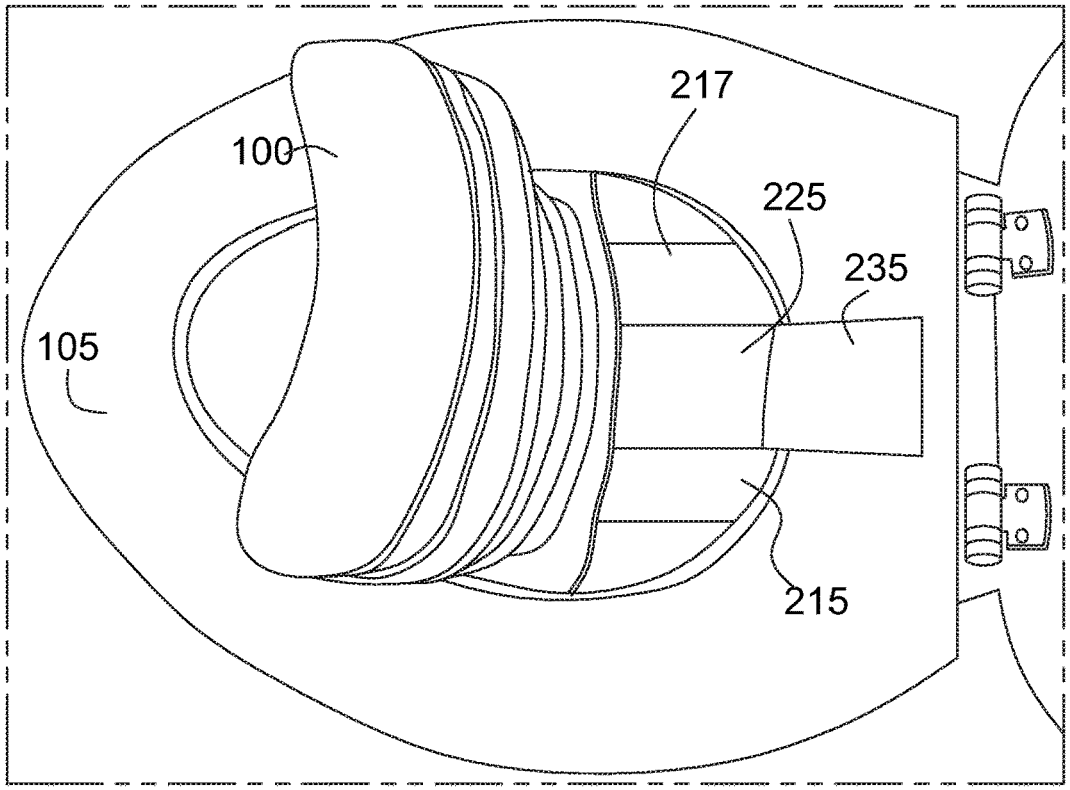
FIG. 17 depicts an embodiment of a toilet aid device as shown in FIG. 16 with the positional indexing facility abutting a toilet seat.

FIG. 17 depicts an embodiment of a toilet aid 100 as shown in FIG. 16 with the positional indexing facility 215 attached to a toilet seat 105 with contact piece 235. Here, three projections 230 of second portion 225 of the indexing facility 215 are inserted in notches 220 of first receiving portion 217.

Figure 18:
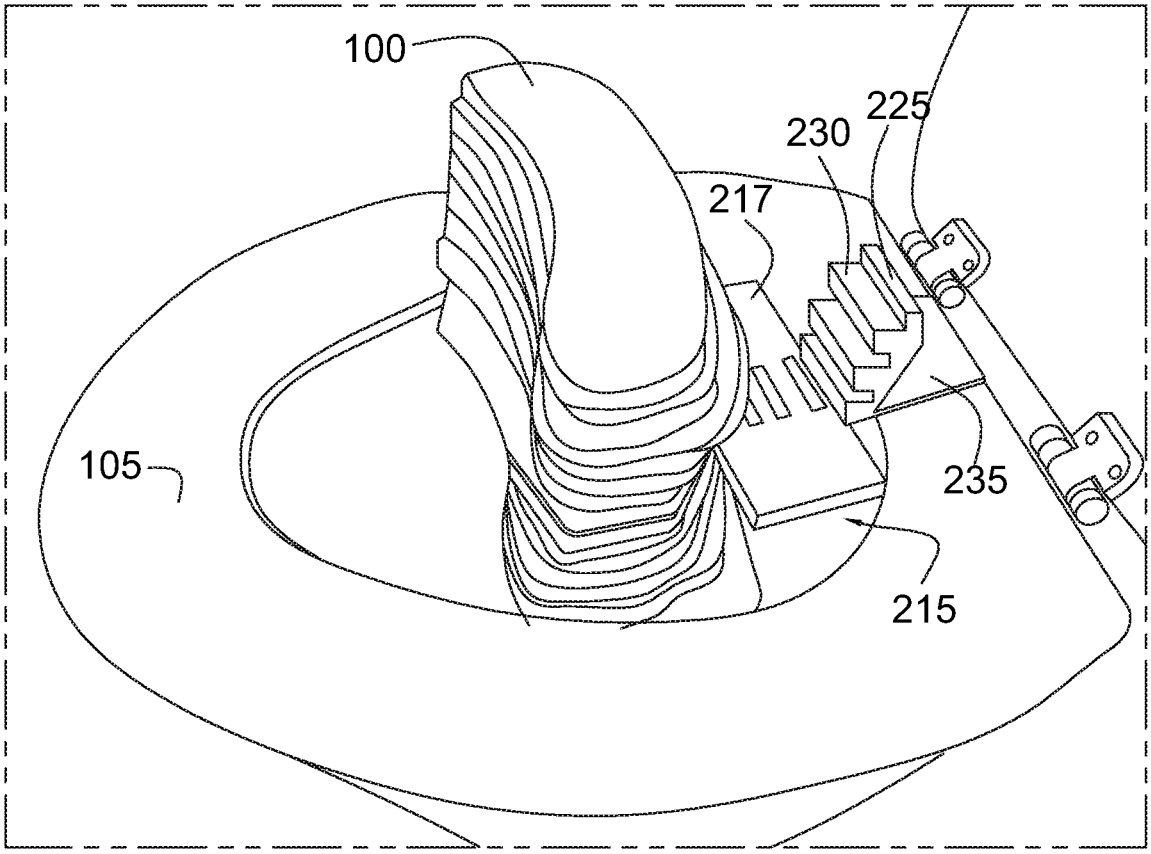
FIG. 18 depicts an embodiment of a toilet aid device as shown in FIG. 17 with the positional indexing facility disengaged.

FIG. 18 depicts an embodiment of a toilet aid 100 as shown in FIG. 17 with the positional indexing facility 215 disengaged. Projections 230 have been removed from notches 220 of first receiving portion 217, allowing for adjustment of the toilet aid 100 and indexing facility 215. Toilet aid 100 may be moved forward or back and one or more projections 230 inserted into corresponding notches 220 to secure the toilet aid in that new position.

Figure 19:
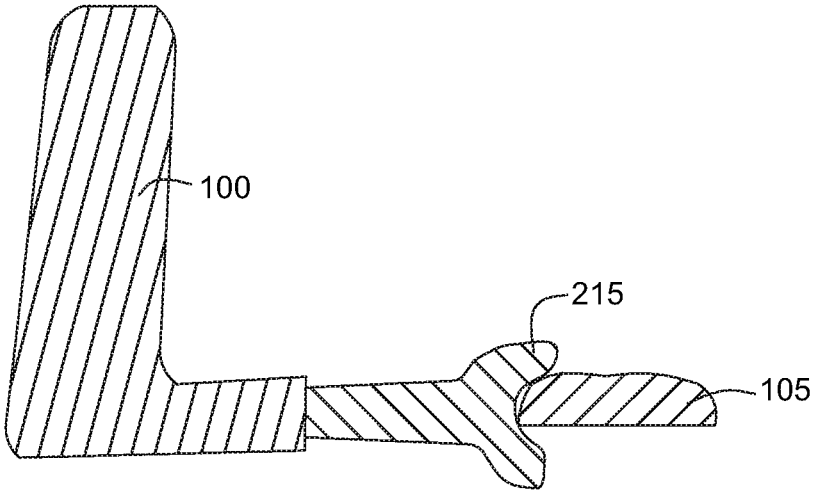
FIG. 19 depicts a cross-section of a positional indexing facility abutting a toilet seat, according to an embodiment.

FIG. 19 depicts a cross-section of a positional indexing facility abutting a toilet seat, according to an embodiment. The indexing facility 215 here prevents rearward movement of the back support 100 by contact with the toilet seat 105, without being attached to the toilet seat 105. In some embodiments, the indexing facility 215 may similarly contact the toilet bowl rim or toilet tank, etc. In some embodiment, the indexing facility 215 may be attached to the toilet seat 105, for example by encircling it, or be attached to another part of the toilet, to provide additional stability.

FIGS. 20-24 depict embodiments of a folding toilet aid. Some such embodiments may be removable and portable, placed and secured to the toilet for use temporarily. Other embodiments may be permanently installed on the toilet. Permanent embodiments may be attached at and to the same hinge used by the toilet seat and lid. They may be manufactured as a single unit including a toilet seat, the versatile folding toilet aid and a toilet seat lid.

In one position, the back support of the folding toilet aid is vertical, and in another position the back support is horizontal. Both positions re-size the toilet seat/bowl opening for a user and help position the user on the seat. In the vertical use position, a telescoping or folding support may secure the backrest in an upright position. The support may be attached to the backrest with a hinge. The other end may clip or fit into a receiver Once retracted, the telescoping or folding support may fit, nest and/or clip into a storage recess/position in the back support. With the support piece stowed, the back support may be used in the horizontal position, or the back support and bottom piece may be tipped up and out of the way for users not needing the aid.

The removable and portable embodiments may have the bottom piece or other part fastened to the toilet with clips, clamps, suction cups, and/or other suitable fasteners. A pad and/or extension and/or group of pads and/or extensions may be fastened to the front of the back support in its vertical position to accommodate positioning requirements of different users.

Figure 20:
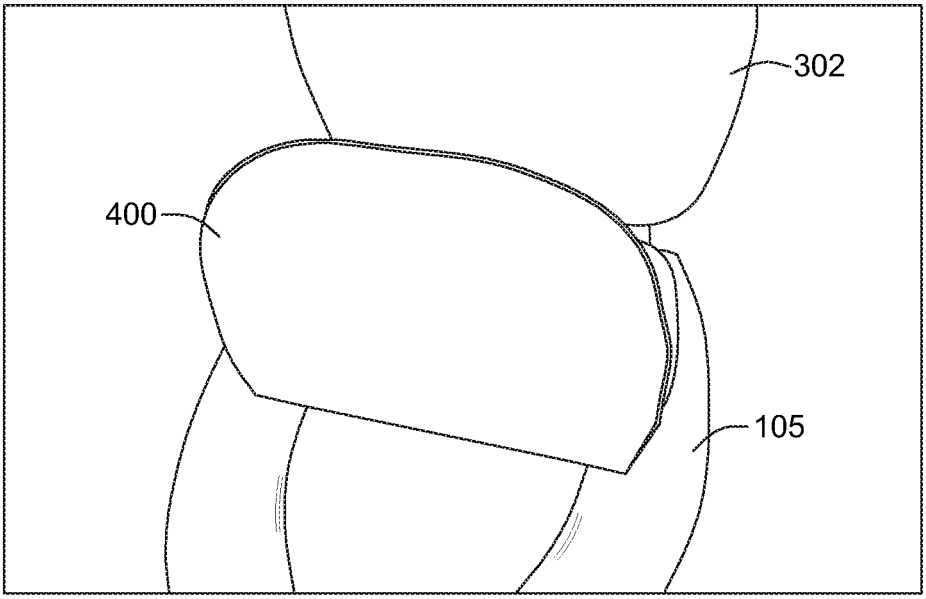
FIG. 20 depicts a folding toilet aid device in a vertical position according to an embodiment.

FIG. 20 depicts a folding toilet aid device in a vertical position according to an embodiment. Back support 400 reduces the effective size of the toilet seat 105.

Figure 21:
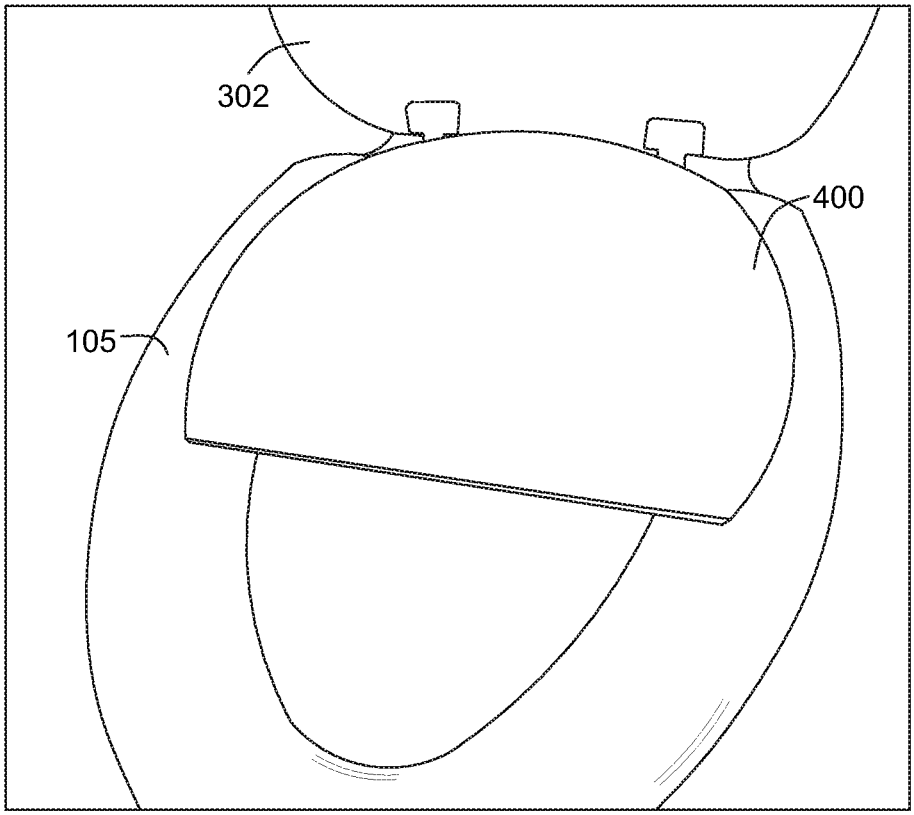
FIG. 21 depicts a folding toilet aid device in a horizontal position according to an embodiment.

FIG. 21 depicts a folding toilet aid device in a horizontal position according to an embodiment. Here, support 400 is folded down flat, parallel to the toilet seat 105. Again, the support 400 reduces the effective size of the toilet seat 105. In this position, the support 400 does not provide any back support, but simply acts as a cue as to where to sit, and helps to prevent a small child from falling through the toilet seat. The support 400 is thin enough to be out of the way and not uncomfortable on a user's back when rotated flat against the toilet seat cover, and thin enough not to keep the toilet seat cover propped open when the toilet seat cover is closed. Embodiments may be of various thicknesses, but may be ¾" or less in thickness. A support 400 that extends less than 2" vertically when in use does not provide significant back support even to the youngest children ready for potty training (generally 12-18 months). Other dimensions may vary based on the size and shape of the toilet seat and of the intended users.

Figure 22:
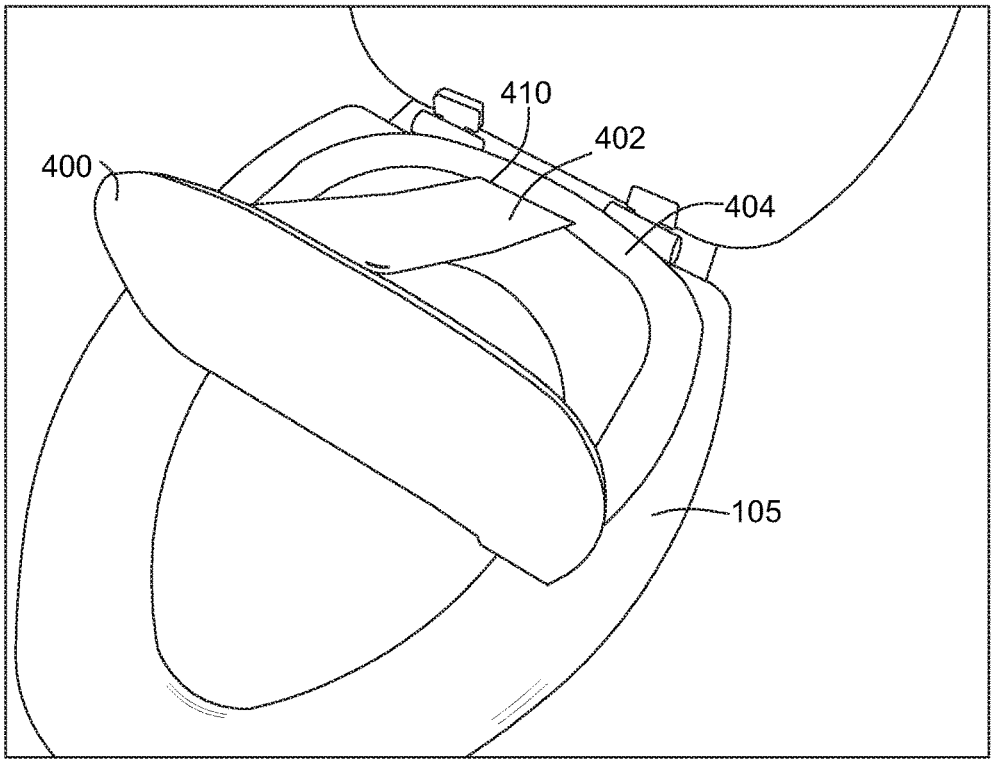
FIG. 22 is a perspective view depicting a folding toilet aid device in a vertical position according to an embodiment.

FIG. 22 is a perspective view depicting a folding toilet aid device in a vertical position according to an embodiment. Support 402 connects to back support 400 and to bottom piece 404 at receiver 410. Receiver 410 may for example be a recess the end of support 402 slides into, or the two parts may clip together or otherwise be releasably fastened in a known manner.

Figure 23:
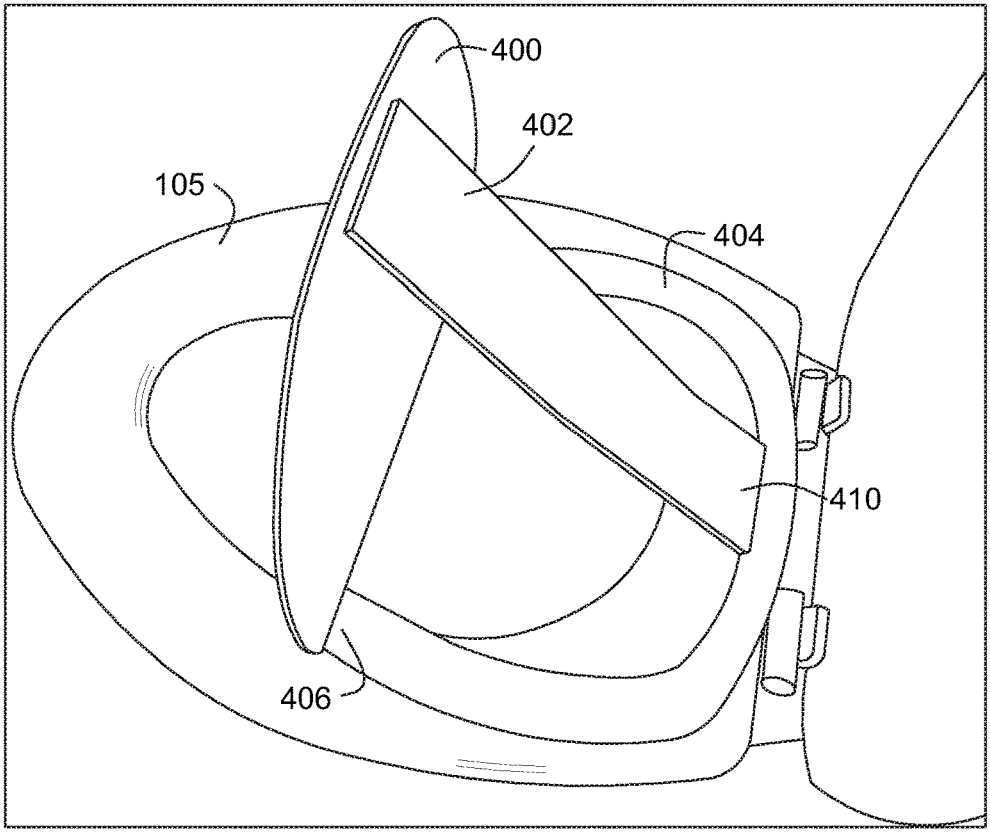
FIG. 23 is a perspective view depicting a folding toilet aid device in a vertical position from the rear according to an embodiment.

FIG. 23 is a perspective view depicting a folding toilet aid device in a vertical position from the rear according to an embodiment. Back support 400 attaches to bottom piece 404 at hinges 406, which may for example be living hinges, allowing the back support 400 to fold down into the horizontal position shown in FIG. 21.

Figure 24:
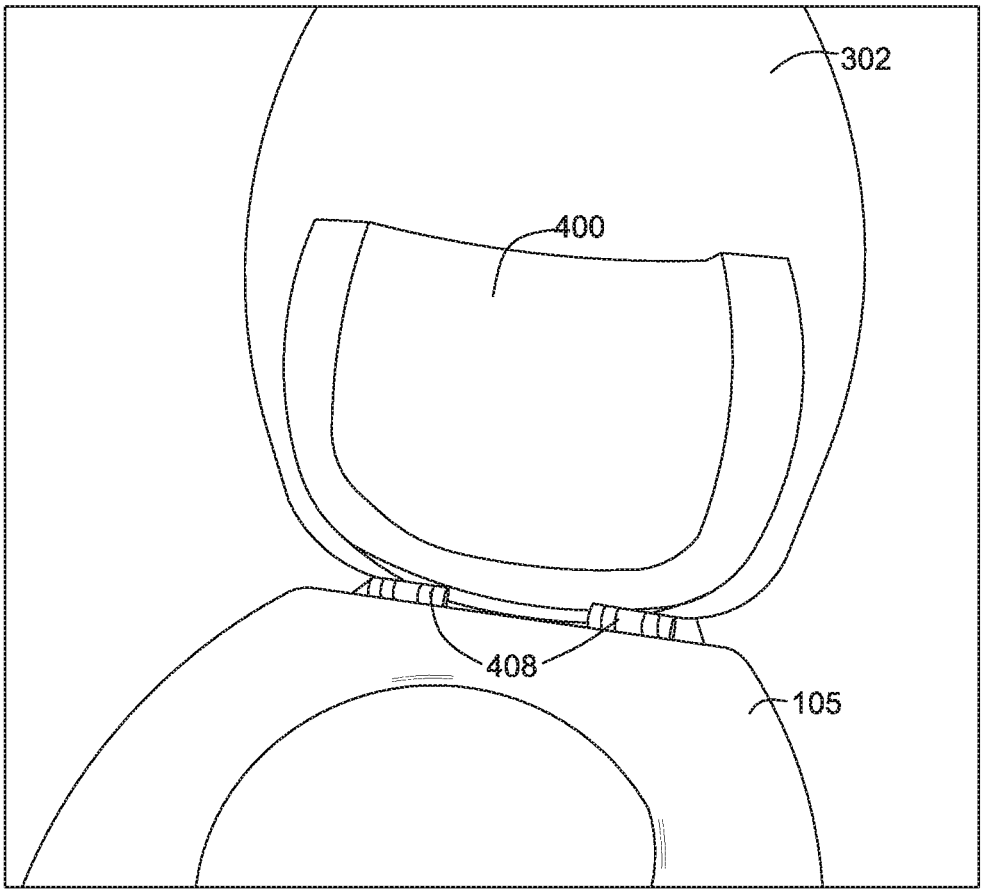
FIG. 24 depicts a folding toilet aid device in a folded up position according to an embodiment.

FIG. 24 depicts a folding toilet aid device in a folded up position according to an embodiment. Here, the support 402 is released form the bottom piece 404 and folded up against the back support 400, and the back support 400 is rotated up on hinges 408, which may be shared with the toilet seat and toilet seat cover 302, flattening the back support 400 against toilet seat cover 302 and out of the way of a user.

In the description herein, numerous specific details are provided, such as examples of components and/or methods, to provide a thorough understanding of embodiments of the invention. One skilled in the relevant art will recognize, however, that an embodiment may be able to be practiced without one or more of the specific details, or with other apparatus, systems, assemblies, methods, components, materials, parts, and/or the like. In other instances, well-known structures, components, systems, materials, or operations are not specifically shown or described in detail to avoid obscuring aspects of embodiments. While the embodiments may be illustrated by using a particular embodiment, this is not and does not limit the invention to any particular embodiment and a person of ordinary skill in the art will recognize that additional embodiments are readily understandable and are a part of the example embodiments.

The invention encompasses every possible combination of the various features of each embodiment disclosed. It will also be appreciated that one or more of the elements depicted in the drawings/figures can also be implemented in a more separated or integrated manner, or even removed or rendered as inoperable in certain cases, as is useful in accordance with a particular application. Benefits, other advantages, and solutions to problems have been described above with regard to specific embodiments. However, the benefits, advantages, solutions to problems, and any component(s) that may cause any benefit, advantage, or solution to occur or become more pronounced are not to be construed as a critical, required, or essential feature or component.

It should also be noted that it is contemplated that the embodiments described herein may have a wide range of applicability, not just for the applications described in detail herein, as would be apparent to one of skill in the art having the benefit of this disclosure.

The particular embodiments disclosed above are illustrative only, as the invention may be modified and practiced in different but equivalent manners apparent to those skilled in the art having the benefit of the teachings herein. Furthermore, no limitations are intended to the details of construction or design as shown herein, other than as described in the claims below. It is therefore evident that the particular embodiments disclosed above may be altered or modified and all such variations are considered within the scope and spirit of the claimed invention. For example, various colors and decorative designs, materials, and structural shapes may be used.

Accordingly, the protection sought herein is as set forth in the claims below.

We claim:

1. A toilet aid apparatus, comprising:

a positioning aid, comprising a back support, configured to position a user seated on a toilet seat by adjusting the effective size of the toilet seat; and a securing mechanism configured to secure the positioning aid to a toilet and thereby fix the effective size of the toilet seat; and a nesting block configured to be attached and added to the front or back of the back support to adjust the effective size of the toilet seat;

wherein the back support comprises a concave surface configured to receive a back of a user.

2. The toilet aid device of claim 1, wherein the nesting block is configured to be disposed in front of the back support.

3. The toilet aid device of claim 1, wherein the nesting block is configured to be disposed behind the back support.

4. The toilet aid device of claim 1, wherein the securing mechanism comprises straps or a loop of solid material disposed on ends of the back support and configured to wrap around a portion of the toilet to secure the back support to the toilet.

5. The toilet aid device of claim 1, wherein the securing mechanism comprises one or more flat surfaces directly connected to the back support and configured to be disposed between a bottom of the toilet seat and a toilet bowl rim, wherein the flat surfaces are configured to receive compressive force from the toilet seat and the toilet bowl rim, thereby securing the toilet aid to the toilet, when a user is in a seated position on the toilet seat and the flat surfaces are disposed between the toilet seat bottom and toilet bowl rim and a gap between the toilet seat bottom and toilet bowl rim in normal operation without the toilet aid device is less than a thickness of the flat surfaces.

6. The toilet aid apparatus of claim 1, wherein the positioning aid is configured such that a user does not sit on any portion of the positioning aid when seated on the toilet seat.

7. The toilet aid apparatus of claim 1, wherein the positioning aid is configured to be moved between an operational position where the positioning aid adjusts the effective size of the toilet seat and a stored position against a toilet seat cover, where the positioning aid is out of the way of users.

8. The toilet aid apparatus of claim 1, wherein the positioning aid does not touch a user's back when the user is seated on the toilet seat.

9. The toilet aid apparatus of claim 1, wherein the positioning aid when installed on a toilet covers less than half of the toilet bowl rim or toilet seat.

10. The toilet aid apparatus of claim 1, wherein the securing mechanism is configured to releasably secure the back support to the toilet, so that the securing mechanism can be released for adjustment of the effective size of the toilet seat.

11. The toilet aid apparatus of claim 1, wherein the back support comprises a vertical surface and the securing mechanism comprises one or more flat surfaces connected to the vertical surface and configured to be disposed between a toilet seat bottom and toilet bowl rim.

12. The toilet aid device of claim 11, wherein the flat surfaces are configured to receive compressive force from the toilet seat and the toilet bowl rim, thereby securing the toilet aid to the toilet, when a user is in a seated position on the toilet seat and the flat surfaces are disposed between the toilet seat bottom and toilet bowl rim.

13. The toilet aid device of claim 11, wherein the flat surfaces comprise side projections extending perpendicularly from the vertical surface.

14. The toilet aid apparatus of claim 11, wherein the one or more flat surfaces are configured to extend from one side of the toilet to the other and connect to the vertical surface on each side.

15. The toilet aid apparatus of claim 1, wherein the back support is configured to rest on top of the toilet seat.

16. A method of using the apparatus of claim 1, comprising positioning the positioning aid to adjust the effective size of the toilet seat to a desired size, securing the positioning aid to the toilet, sitting on the toilet without sitting on the positioning aid, and repositioning the positioning aid to adjust the effective size of the toilet seat to a second desired size.

17. A method of using the apparatus of claim 5, comprising inserting the flat surfaces between the toilet seat bottom and toilet bowl rim, sitting on the toilet seat and not on the positioning aid, and thereby compressing the flat surfaces between the toilet seat bottom and toilet bowl rim and securing the positioning aid in place.

* * * * *